US005133196A

United States Patent [19]

Tibbals, Jr.

[11] Patent Number: 5,133,196

[45] Date of Patent: Jul. 28, 1992

[54] CIRCULAR WEFT KNITTING MACHINE

[75] Inventor: E. C. Tibbals, Jr., Jamestown, N.C.

[73] Assignee: Draper Corporation, Greensboro, N.C.

[21] Appl. No.: 719,131

[22] Filed: Jun. 20, 1991

Related U.S. Application Data

[60] Division of Ser. No. 228,957, Aug. 5, 1988, Pat. No. 5,035,124, which is a division of Ser. No. 901,298, Aug. 28, 1986, Pat. No. 4,763,492, which is a continuation-in-part of Ser. No. 398,303, Jul. 14, 1982, Pat. No. 4,608,839.

[51] Int. Cl.[5] ..... D04B 9/00

[52] U.S. Cl. ..... 66/35; 66/13

[58] Field of Search ..... 66/13, 35, 36, 37, 38

[56] References Cited

U.S. PATENT DOCUMENTS

| | | | |
|---|---|---|---|
| 291,377 | 1/1884 | Merrow | 66/35 |
| 1,744,789 | 1/1930 | Miller | 66/35 |
| 3,972,206 | 8/1976 | Mureso | 66/36 A X |
| 4,423,606 | 1/1984 | Hofmann | 66/13 |
| 1,871,1901 | 8/1932 | Miller | 66/35 |

*Primary Examiner*—Werner H. Schroeder
*Assistant Examiner*—John J. Calvert
*Attorney, Agent, or Firm*—Rhodes, Coats & Bennett

[57] ABSTRACT

In a circular knitting machine of the type in which the needles are selectively moved into and out of operative relationship with needle cam tracks, flexure of the lower portion of the needle shanks properly locates the lower end portions of the needle shanks in close proximity to selection devices. Such flexure is effected by a plurality of individually radially displaceable rollers. The rollers are disposed in rolling engagement with the outer surface of a flexible band which, in turn, is positioned around the needle cylinder in closely encircling relationship to the needle members at a point below and on the opposite side of a fulcrum located adjacent to and near the upper end of the needle members. As the needle cylinder rotates, the rollers are engaged by cams and displaced toward the needle shanks. The rollers thus engage and inwardly displace portions of the band and thus the needle members therebehind, effecting movement of the needles into close proximity to the selection devices.

3 Claims, 11 Drawing Sheets

CIRCULAR WEFT KNITTING MACHINE

This application is a division of application Ser. No. 228,957, filed Aug. 5, 1988, now U.S. Pat. No. 5,035,124 and which, in turn, was a division of application Ser. No. 901,298, filed Aug. 28, 1986 (now U.S. Pat. No. 4,763,492). Application Ser. No. 901,298 was a continuation in part of application Ser. No. 398,303, filed Jul. 14, 1982 (now U.S. Pat. No. 4,608,839). The specification and drawings of the aforedescribed U.S. Pat. Nos. 4,763,492 and 4,608,839 are hereby incorporated in the file of the present case, by reference and in their entirety.

This invention relates to circular knitting machines and, more particularly, to selectively programmmable, electronically controlled circular weft knitting machines of improved character for the economic and high speed fabrication of variously shaped and/or patterned tubular knit-wear items such as diversiform and variegated hosiery of both the sock and stocking categories, selectively patterned fabrics and the like.

BACKGROUND OF THE INVENTION

Circular weft knitting machines of the general type herein of interest are both old and well known in the art. The basic precepts determinative of the circular weft knitting operation extend back over 70 years and the intervening period has been characterized by a progression of generally relatively minor and essentially unitary component improvements, all to the general end of increasing machine speed and/or versatility but, in general, with little or no radical departures from fundamental structure or mode of operation.

While the machine variants employed in present day commercial operations are legion, most, of not all, of the commercially available circular weft knitting machines conventionally include a rotatably displaceable cylinder member having a multiplicity of longitudinal grooves on its outer surface, with each of said grooves containing and guiding a single frictionally restrained but reciprocally displaceable knitting needle member therein. Such needles are selectively displaced in relation to a yarn feed location to permit successive needle-yarn engagements and introduction of engaged yarn into the previously knit portions of the article being fabricated. Among the known needle member constructions, the most commonly employed is the so-called "latch" needle employing a pivotally mounted latch element at the hook bearing end of the needle element that is rotatably displaceable between a hook open and a hook closed position. Another variant, the so-called "compound" needle employs a separate and independently displaceable longitudinally reciprocable closing element in association with each needle element. Such compound needle construction has long offered marked advantages in both fabric quality and speed of fabric formation through diminution of stroke length and permitted positive closing element control; however such advantages have never attained substantial commercial fruition. Another known needle construction is the so-called "spring-beard" needle which does not reciprocate longitudinally of the rotating knitting cylinder. A common field use for such needles has been in the fabrication of sweatshirts and similar articles.

Individual needle reciprocation for the most commonly employed latch type needle within its respective path defining and confining groove on the periphery of the knitting cylinder has not been most commonly initiated and effected through needle engagement with elevating cams with the latter in turn being operatively controlled through selectively shaped "selection jacks". In turn, each selection jack is vertically actuated by a jack cam induced displacement after radial displacement by a presser cam. An associated control selector, conventionally an extending pin on a rotating drum or the like adapted to engage the selector plate cams which in turn contact the selection jack, operates to associate or dissociate the selection jack from the jack cam. When the selection jack is displaced by the jack cam it elevates an extending cam butt on the needle into operative driving engagement with an adjacent cam track or the like. In such systems, the pin location settings of the control members and selection jack butt contour essentially constitute a mechanical program to selectively displace the needles, through intermediate displacement of their respective selection jacks, into operative engagement with an associated cam track and to thereby control both the nature and extent of reciprocable needle displacement and which, in turn, is at least partially determinative of workpiece configuration and patterning. In such mechanically programmed machines, the selection jacks are normally selectively contoured and such jacks, together with the mechanical programming device must be modified and/or replaced whenever a configuration or pattern change in a product being fabricated is involved. That is to say, while such conventional circular weft knitting machines may be mechanically programmed to produce a particular shape and/or pattern for a given product they must also be basically modified, a relatively time consuming and expensive manual procedure requiring highly skilled personnel, whenever the shape and/or pattern of the product is to be changed. One practical result of such required program modification is either excessive machine downtime or buildup of undesired inventory if units are permitted to continue operation after completion of a particular order. In conjunction with the above, conventional machine structure has generally also operated to limit mechanical programming to a selection between "tucking" or "floating" or to a selection between "knitting" or "floating" at a given yarn feed location. Conventional mechanical construction or heretofore electronically programmable machines do not provide for Jacquard selection among "knitting", "tucking" and "floating" operations at each yarn feed location.

Apart from the above noted time-consuming and expensive character of manual program modification, the conventional circular weft knitting machines are also highly and unduly dependent upon the immediate availability of such highly skilled personnel in order to maintain any appreciable continuity of operation. Among the continued set-up and maintenance operations required is the bending or "setting" of the needle elements necessary to maintain the requisite degree of frictional engagement thereof within the slots on the knitting cylinders to avoid inadvertent dispacement thereof and the selective modification of parts including part reshaping and redefinition of frictionally engaged surfaces such as cam tracks and the like, to accommodate wear.

Over the more recent years and in an effort to increase machine versatility and accommodate greater fabric patterning complexities, attempts have been made to incorporate electromechanical needle selection and displacement control systems in circular weft knitting machines, such as by actuating selection jack displacement through tape controlled solenoids or the like. However, such improvements, at least to date, are ones of degree only and have not, because of practical considerations such as undue power consumption, slow speed of operation and lack of operational reliability, been commercially employed on any widespread basis.

Commercially circular weft knitting machines also conventionally employ a multiplicity of "sinker" members, each radially reciprocable relative to the knitting cylinder and in a path essentially normal to that of needle displacement, to cooperate with the yarn feed and with the individual needle members in effecting stitch draw and stitch hold-down operations. Such sinkers are conventionally mounted on either an internal sinker pot or an external sinker bed plate rotatable with the rotatable knitting cylinder and are individually radially displaced relative thereto by a separate cam track. Conventionally, the initiation and extent of individual radial sinker displacement is selectively determined by the character of such cam track. Certain recent developments have been directed to incorporating a limited capability to independently move the sinker members in the vertical direction intermediate periods of radial displacement thereof in order to reduce yarn tension and barre. However such developments have had only limited commercial use at the present time, largely because of mechanical problems attendant thereto.

While circular weft knitting machines conventionally employed in fabric knitting employ only a single direction of knitting cylinder rotation, circular knitting machines conventionally employed in hosiery fabrication often incorporate means for effecting reversal of direction of knitting cylinder rotation. Such machines, however, have been capable of traversing only a single fixed distance in the reverse direction in accord with machine design. Such machines also employ two individually nonsymmetrical but essentially 180° out-of-phase or reversed cam track contours, each adapted to accommodate only unidirectional needle element movement therewithin, to achieve stitch draw and latch clearing operations for such bidirectional knitting cylinder displacement. In such standard construction, not only are two individually nonsymmetrical cam tracks employed, but such cam tracks are necessarily "open" at the crossover or junction points, at which location the needle members are subject to undesired and/or uncontrolled displacement in the vertical direction. As noted above, needle displacement, in conventional circular knitting machines, is effected against the frictional forces normally restraining needle movement and such frictional forces are normally the only forces that operate to restrain undesired and unintentional needle movement as might occur at the open cam track crossover points or the like.

Conventioal circuolar weft knitting machines are also generally characterized by a multiplicity of selectively positionable components that are determinative of the nature of the displacement paths taken by the yarn engaging elements in the knitting operation both in accord with the nature of track defining surfaces thereon and in accord with how such components are positioned relative to other machine components. Within this two variable environment, modification of both the contour of the control track surfaces and the positioning of the components is most usually manually effected for each yarn feed within each machine in accord with the visually observed nature of the product being fabricated. Such manual modification and positional adjustments are not only effected in accord with the desires of individual maintenance personnel but have the cumulative result that every machine is or rapidly becomes effectively unique in both its structure and in its operation with an accompanying cumulative lack of reliability of operation on a repetitive basis.

It is often desirable to incorporate, in circular weft knitting machines, the capability of forming a so-called "terry cloth" type of surface on all or on a portion of a knitted article such as on the sole and/or heel portions of a sock to enhance both wearer comfort and durability. Such "terry cloth" surface is formed by incorporating into the weave a multiplicity of extending yarn loops, conventionally termed "terry loops". In most circular weft knitting machines, the formation of such "terry loops" is conventionally effected through the use of sinkers with an elevated land which serves to divide the converging yarns during the stitch draw operation. Other circular weft knitting machines employ auxiliary yarn feed engaging elements known as terry "bits" or terry "instruments". In the latter type construction, the terry bits are conventionally mounted for individual radial displacement relative to the knitting cylinder and in a path normal to that of needle displacement within a terry dial in a suspended housing assembly disposed above and coaxial with the knitting cylinder. Such terry bits conventionally include a cam butt that is selectively engageable with one of two stationary cam tracks. When a terry bit cam butt is operatively engaged in one of such cam tracks, the terry bit is appropriately subject to radial displacement and cooperates with the reciprocating needles and the yarn feed mechanism to form the desired terry loops. In contradistinction thereto, when the terry bit cam butts are disposed in the other cam track, the terry bits will be positioned in a retracted location out of the path of needle displacement and yarn feed and are so rendered effectively inoperative.

As pointed out above, the development of circular weft knitting machines of the type herein of interest has been characterized by a progression of generally relatively minor and essentially unitary component improvements with little or no radical departures from fundamental structure or mode of operation. The economic pressures that have been attendant recent years have served however to accentuate the long recognized and continued need for circular weft knitting machines of significantly increased reliability and expanded versatility as to increased pattern and contour capabilities in general, a marked diminution in the dependence upon the highly skilled set-up and maintenance personnel who are of limited availability and for circular weft knitting machines of significantly increased speed of operation with consequent higher unit production rates as well as a diminution of the time required for machine changeover to accommodate either product or pattern changes. Unfortunately, however, commercially available circular weft knitting machines have not met such needs and are, at the present time, generally subject to one or more of the following disabilities, the net effect of which has effectively precluded the attainment of the desired objective of the provision of an improved circular knitting machine of significantly increased reliability, versatility, speed of operation and economy of production.

Among such long recognized disabilities are an inherent lack of reliability of machine operation; undue downtime required for machine modification to accommodate product or pattern change; undue dependence upon the unique abilities of individual maintenance personnel; cumulative modification of individual machine components in accord with exigencies directed by visual product observation; limitation on stitch draw speed directly attributable to necessary usage of needle butt cam track slopes of 45° or less in association with vertically fixed verges or sinkers; the inability of machines employing latch type needles to positively control latch element displacement independently of needle reciprocation; the lack of an effective control over stitch length; excessive length of required needle displacement; speed limatations inherent in mechanical needle selection and in the power usage and speed limitation attendant electromechanical needle selection and in the conventional employment of surface interrupted cam tracks controlling the nature and extent of needle displacement; the lack of effective means to assure uniform yarn feed; inability to control yarn tensions and the robbing back of yarn from immediately preceding knit operations and consequent product variation; the limitation of the number of permissible yarn feed stations within a 360° circumference for a given knitting cylinder diameter; a basic lack of awareness of the status of the actual knitting operation in progress in comparsion to desired programmed operation, except through visual observation of the product being fabricated; inability to selectively vary terry loop lengths; the inability to utilize a plurality of simultaneous yarn feeds and to produce uniform fabric from each feed; and the inability to symmetrically operate when the knitting cylinder is in a reciprocatory or bidirectional mode of operation.

The foregoing are but some of the generally characteristic, if not inherent, structural and operational limitations of the state of the art circular weft knitting machines. The subject invention, as hereinafter described and claimed, represents a radical departure from conventional technology in a number of the basic circular weft knitting machine operational steps and component subassemblies, the individual and combined effect of which is to provide a markedly inproved and electrically preprogrammable circular weft knitting machine construction that incorporates novel methods of machine operation and component displacement to the end of providing commmercially significant and readily realizable improvements in product contour and pattern versatility at significantly increased speeds, with improved operational reliability and attendant economies of operation that flow therefrom and from reduced dependence upon highly skilled maintenance and operating personnel

SUMMARY OF THE INVENTION

As noted above, this invention comprises a selectively programmable, electronically controlled circular weft knitting machine of markedly inproved character and reliability for the economic and high speed production of variously shaped and patterned tubular knitwear items. Such improved machine is compositely constituted of, and characterized by, marked inprovements in a number of the basic circular weft knitting machine components and in the operational modes thereof which serve to contribute, both individually and collectively, to the attainment of the desired objective of reliable, high speed and economic production of variously shaped and patterned tubular knitwear items.

More particularly, the present invention is directed to a unique approach to the selective movement of the needle members of such a machine into an out of operative relationship with their associated cam tracks by an initial flexure of the lower portion of the needle shanks. Such flexure is effective by locating or defining a fulcrum on the needle cylinder near the upper ends of the needle members for causing a flexure induced displacement of the shank portion of the needles when a force is applied to a point below and on the opposite side of the fulcrum. A flexible band is disposed below the fulcrum in closely encircling relation to the upper portion of the rotatably displacement knitting cylinder and an interfacial engagement with the opposite surface of the needle members which, themselves, are slidably contained within guide channels within the knitting cylinder. When portions of the flexible band are then deflected at selected locations, the needle members therebehind are inwardly displaced relative to the fulcrum to effect a dimensionally enhanced inward displacement of the lower shank portions thereof.

In a preferred embodiment, the portion of the flexible band are deflected by a plurality of individually radially displaceable roller elements disposed in rolling engagement with the outer surface of the flexible band. A fixed cam track is disposed in spaced encircling relation with the flexible band for selectively displacement the aforesaid rollers radially of the knitting cylinder to thereby inwardly displace portions of the flexible band at the selected locations.

A primary object of the subject invention is the provision of an improved needle member selection and displacement system for circular knitting machines.

A further object of the subject invention is the provision of an improved selection and displacement system for the needle and closure elements of compound needle members in association with two dimensional displacement of sinker members in circular weft knitting machines.

Still another object of this invention is the provision of a compound needle member displacement system that employs closed continuous control cam tracks for effecting selected permutations of needle element displacement and closing element displacement.

Still another object of this invention is the provision of an improved circular weft knitting machine construction whose control cam tracks for needle member displacement are of closed continuous character symmetrical both about the yarn feed location and about an intermediate operation selection point.

As pointed out above, the circular weft knitting method and machine forming the subject matter of this invention embodies pronounced departures from many of the structural and operational interrelationships that have long characterized the more or less conventional or standard circular weft knitting machines of the art. Included therein are numerous changes in basic modes of operation and in a basic machine structure, all of which contribute in varying degrees to the new and improved results that are attainable through usage of the subject matter hereof. The foregoing stated objects and advantages are not all-inclusive and do no more than note some of the broad advantages and object of the invention.

To the above ends, other objects and advantages of the subject invention will be pointed out herein or will become apparent to those skilled in this art from the following portions of this specification and from the appended drawings which set forth, pursuant to the mandate of the patent statutes, the general structure and mode of operation of a circular weft knitting machine incorporating the principles of this invention and presently deemed to be the best mode for carrying out such invention. In conjuction therewith, it should be specifically noted that while the hereinafter described embodiment is particularly directed to a circular weft knitting machine adapted for sock fabrication, the principles of this invention are equally applicable to larger diameter knitting machines for general knit fabrics production and also to knitting machines for ladies hosiery and like articles.

Referring to the drawings.

Detailed Description of a Preferred Embodiment

FIGS. 1 through 15 relate to alternative and presently preferred constructions for certain operating areas of circular weft knitting machines that incorporate the principles of this invention as delineated in the circular knitting machine previouslly described above. This presently preferred construction reflects various modifications and improvements in structure and related function directed to the ends of simplification of construction, permitted economies in fabrication, enhanced operational control, enhanced reliability of operation and an expanded field of utility.

The hereinafter described presently preferred machine construction operates and functions in essentially the same manner as that described in detail above in conjuction with the embodiment illustrated in U.S. Pat. No. 4,608,839 . In light thereof, the hereinafter set forth machine description will be essentially directed only to the modified component structures and to the functions and modes of operation attendant thereto and, to the extent possible in the interests of both clarity and brevity, redundancy of description with that set forth in conjuction in the heretofore described machine will be advoided. It should be understood however that implicit reliance will be placed upon the preceding detailed description of the knitting machine embodying the principles of the invention for satisfaction of the statutory requirements of adequacy of disclosure. The following portions of this disclosure will be premised upon an assumed awareness and understanding of both the basic structure and modes of operation of the previously described circular weft knitting machine.

In general and for the purposes of preliminary orientation, the areas of the knitting machine wherein significant structural and functional modifications have been introduced include the following:

1. Addition of clamping butts at the top of the needle element and closing element of the compound needle to preclude undesired vertical displacement of either the needle or closing elements during the selection process.
2. Modification of the sinker element configuration and the sinker drive system to accomodate an increased range of stitch length control and to compensate for variations in yarn elasticity.
3. Positive engagement of the needle and closing element of the compound needle assembly adjacent to the upper fulcrum point during selection operation.
4. The direct drive of knitting cylinder without interposition of intermediate transmission components.
5. An improved presser cam assembly at selection zones.

The above delineated areas will be hereinafater individually described, but not necessarily in the above order. Again it will be stressed that, in the interests of clarity and brevity, the hereinafter portions of this specification will be based upon an assumed understanding and knowledge of both the structure, functions and modes of operation of the previously described circular weft knitting machine.

Figure 1:
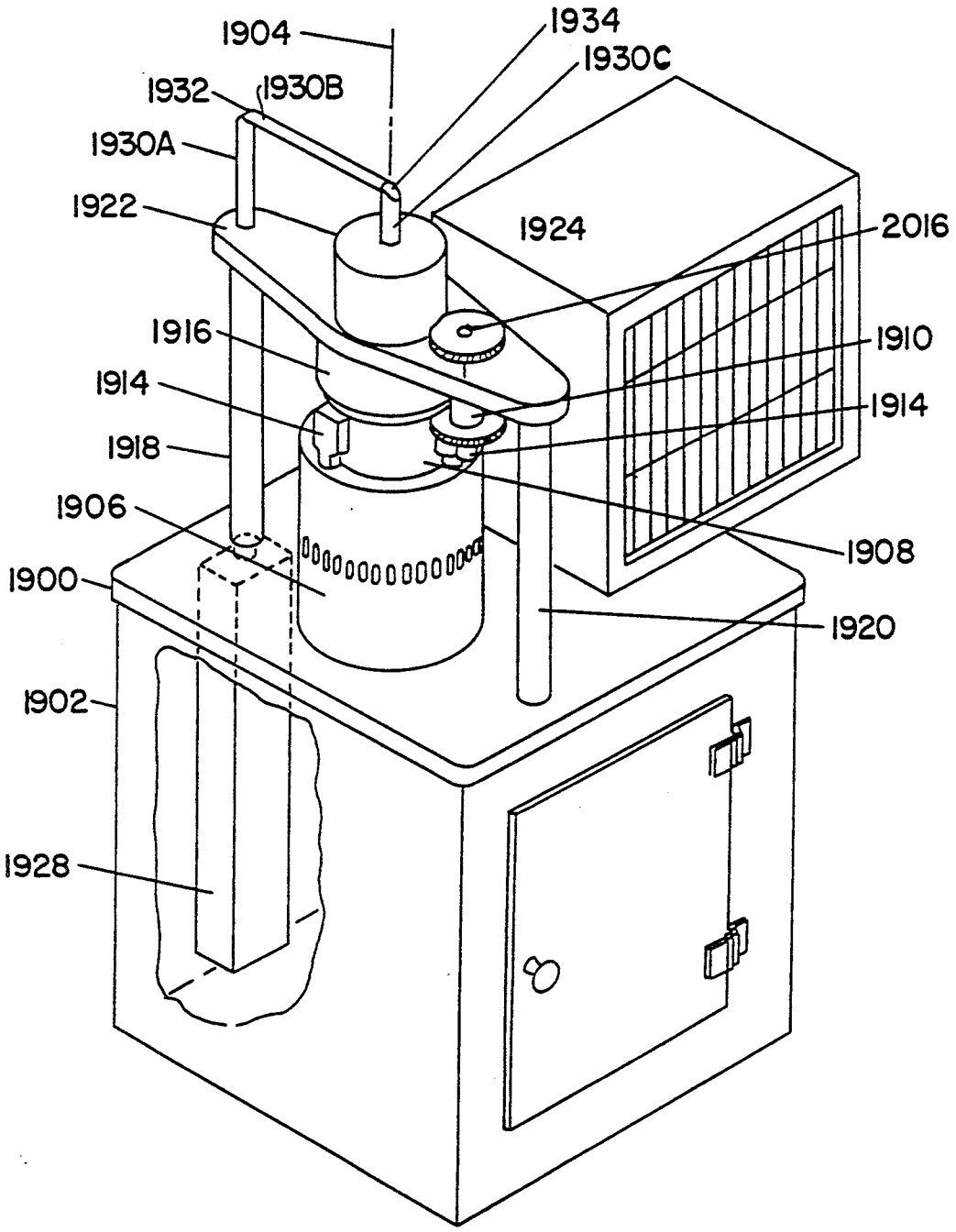
FIG. 1 is an oblique view schematically illustrative of a presently preferred and somewhat modified construction for a circular weft knitting machine incorporating the principles of this invention.

Referring initially to FIG. 1, the presently preferred construction includes a selectively contoured main support plate 1900 mounted on a cabinet like base 1902 which is adapted to contain the power supplies for the main drive motor and the computer, the vacuum takedown turbine for sock delivery and the associated sock delivery mechanisms none of which are believed to be of novel character and are not further described herein. The support plate 1900 includes a central sock delivery bore (not shown) having a vertical longitudinal axis 1904, which serves as the common vertical longitudinal axis for the hereinafter described machine components mounted on the support plate 1900. Mounted on the support plate 1900 is an elongate and generally cylindrical motor housing 1906, a reduced diameter frame or housing section 1908 for the knitting components having drive system appendage 1910 extending therefrom and for mounting certain of the selection system components 1914. Mounted thereabove is a portion of the housing 1916 enclosing the sinker assembly. Disposed above the sinker assembly housing 1916 and supported by a pair of standards 1918 and 1920 is a platform 1922 that houses the yarn feed mechanisms and various dial mechanisms 1924 for terry loop formation, radial dial needles and the like. Appendage 1910 accomodates the drive for the auxiliary drive shaft 2016 for transmitting operative power to the overlying components in housing 1924.

Also schematically depicted on FIG. 1 is a laser yarn severing system which includes a CO laser 1928 whose beam is directed through a conduit 1930A and after reflection by mirrors 1932 and 1934 is impinged on a rotating mirror positioned on vertical longitudinal axis 1904, which directs the laser beam to an appropriate location for yarn severance.

As indicated above, the presently preferred constructions are directed only to certain machine component areas. Such areas as to where modification has been effected will be hereinafter individually described, it being presumed that such constitutes a supplement to the basic construction and modes of operation that were set forth in detail in the earlier portion of this specification.

BASIC MACHINE ORGANIZATION AND MACHINE DRIVE SYSTEM

Figure 2A:
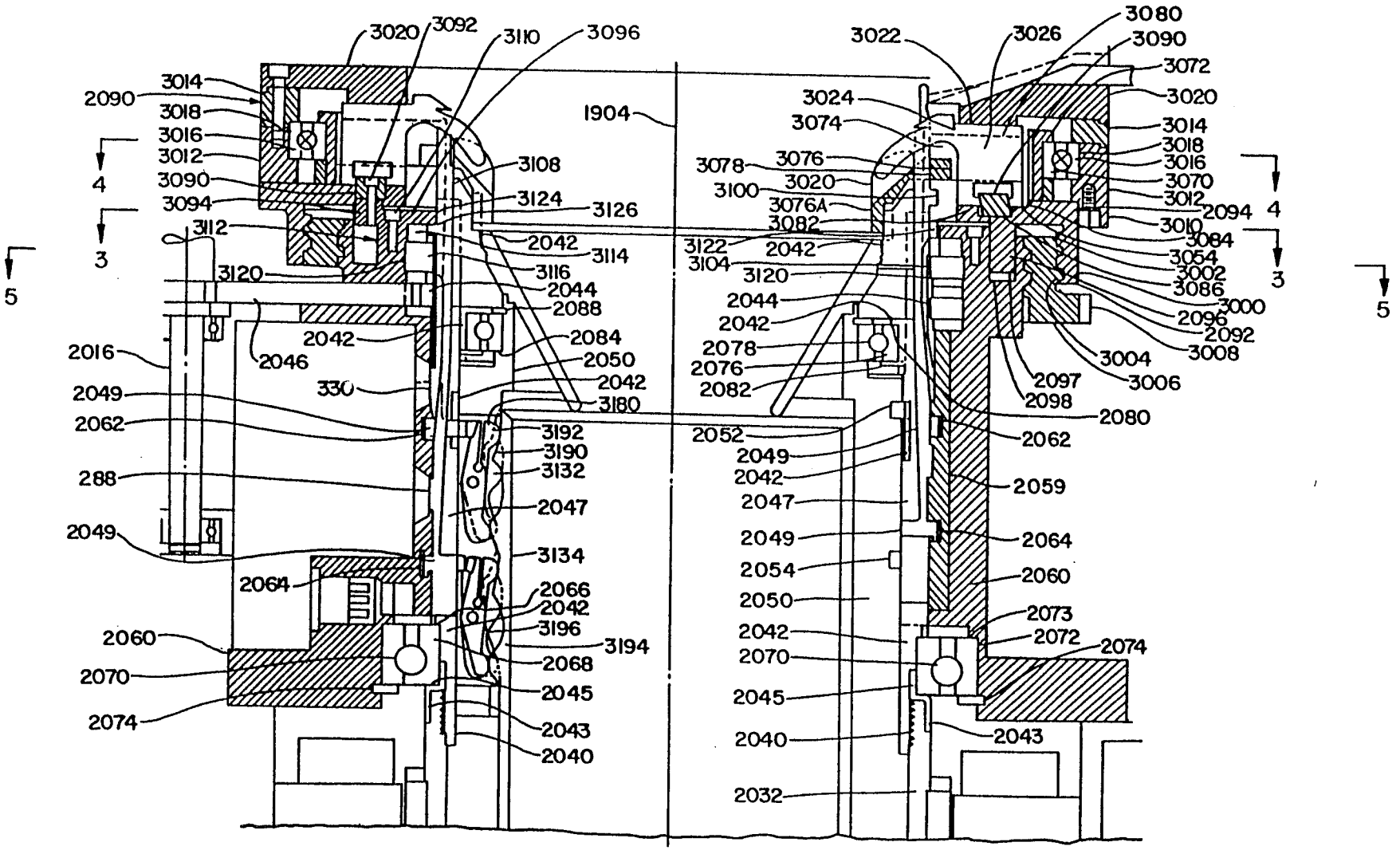
FIGS. 2A and 2B are vertical sections of the upper portion and the lower portion of the knitting machine shown in FIG. 1 and depicting, on the left hand side thereof, component positioning at a selection point intermediate a pair of yarn feed locations and, on the right hand side component positioning at a yarn feed location.
Figure 2B:
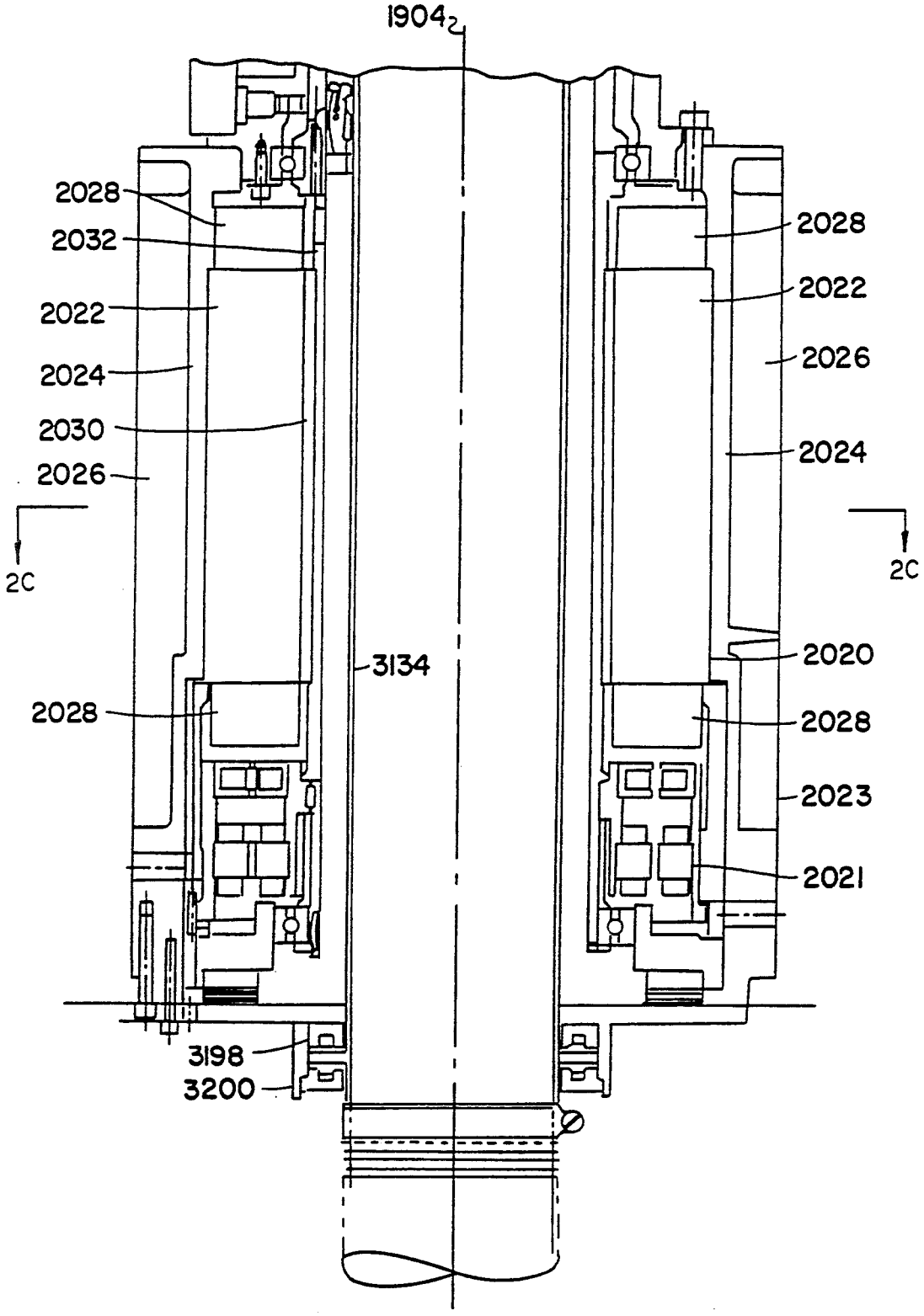
Figure 2C:
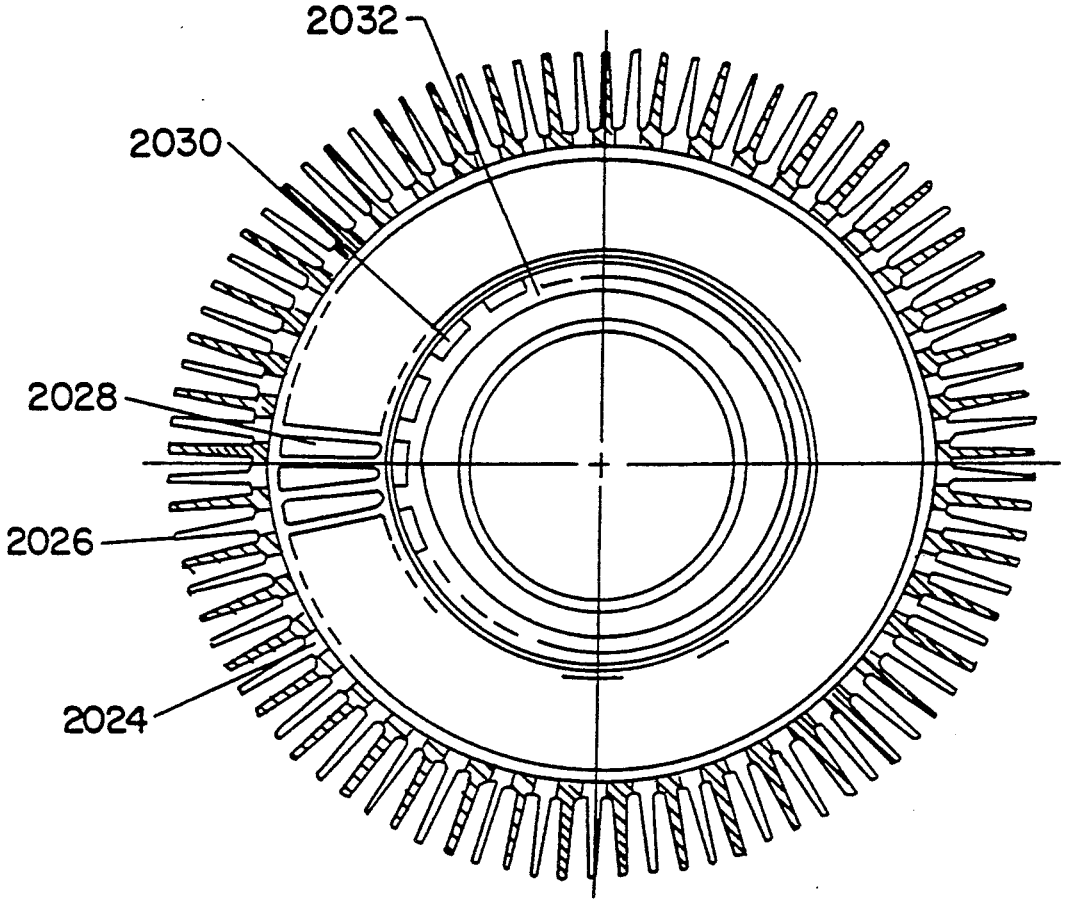
FIG. 2C is a horizontal section as taken on the line C—C on FIG. 2B.

As best shown in FIGS. 2A, 2B and 2C the presently preferred construction includes an improved and simplified arrangement and drive system for the knitting needle support cylinder and for an improved sinker assembly associated therewith. To the above ends, there is provided a brushless, hollow core, electronically commutated, rare earth magnet type main drive motor 2020 disposed in concentric surrounding relation to the longitudinal machine axis 1904. Motors of this general type are commercially obtainable from Clifton Precision Co. of Philadelphia, Pennsylvania and from Motion Control Systems of Radford, Va. The main drive motor 2020 is utilized in association with a high precision hollow core resolver 2021 and a rotary transformer position read out device 2023 for motor rotor position control purposes. The motor 2020 includes a cylindrical housing 2024 having a plurality of cooling fins 2026 extending outwardly therefrom. Disposed within the housing 2024 is a cylindrical stator 2022 containing the motor windings 2028. Disposed within the stator 2022 and positioned in closely spaced interfacial relation therewith is a rotor element made up of a cylindrical assemblage 2030 of rare earth (Sm/Co) magnets mounted on a cylindrical rotor element 2032.

Mounted on the upper end of the rotor element 2032, as by a securely interlocked threaded interengagement 2040, is the lower end of a rotatable knitting needle support cylinder 2042. Interlocking of the motor rotor 2032 with the knitting needle support cylinder 2042 is effected by the interposition of a bearing clamping ring 2043, whose shoulder 2045 also performs a support function for the main cylinder bearing 2070, as will be hereinafter described. The direct interconnection of the motor rotor element 2032 with the knitting needle support cylinder 2042 permits the latter to be rotatably displaced in direct accord with, and in direct response to, controlled displacement of main drive rotor element 2032. Such direct drive affords reduced polar moment of inertia, eliminates backlash, and substantially increases torsional stiffness. In addition, the use of such a hollow core rotor 2032 permits direct finished sock delivery through the drive motor 2020 with attendant elimination of gear trains and the like on the drive system.

The knitting needle support cylinder 2042 is of essentially the same general configuration as that described in the initially described embodiment and contains a plurality of longitudinally disposed radial slots 2047 on its outwardly facing surface, each of which is adapted to contain and guide the path of displacement of individually displaceable compound needle elements, generally designated 2049.

A ring drive gear 2044 is mounted in encircling splined relation on the outer surface of the knitting needle support cylinder 2042 near the upper end thereof. The ring drive gear 2044 intermeshes with and drives an associated gear 2046 which is mounted on and keyed to the auxilary drive shaft 2016 for transmittal of motive power to the machine components associated with the overlying platform 1922. As will now be apparent, the displacement of the auxiliary drive shaft 2016 is always in direct accord with and is directly mechanically synchronized with the displacement of the knitting needle support cylinder 2042, with advantages akin to those above noted.

Disposed within the knitting needle support cylinder 2042 and positioned in close interfacial relation thereto is the outer surface of a nonrotatable stationary inner cam track sleeve member 2050. As was previously described earlier in more detail in conjunction with the inner cam track sleeve member 78, and as shown on the right hand side of FIG. 2A, the inner cam track sleeve member 2050 includes an upper cam track 2052 and a lower cam track 2054 on the outer surface thereof facing the knitting cylinder for accomodation of the extending butt portions on the lower ends of the closing element and needle elements respectively.

Disposed in surrounding close interfacial relation with the outwardly facing surface of the knitting needle support cylinder 2042 is the inner face of a nonrotatable, outer cam track face 2059 mounted in a stationary outer frame member 2060. The face 2059 contains an upper cam track 2062 and a lower cam track 2064 for accomodation of the extending butt portions on the lower ends of the closing elements and needle elements respectively similar to that earlier described for cam track sleeve 86 in the previously disclosed embodiment. In the herein disclosed embodiment the cam tracks 2062 and 2064 could be formed on the interior surface of the frame member 2060, thus obviating the need of a separate insert as a supportive element therefore. As such, it performs the same compound needle control functions as the earlier described outer cam track sleeve member 86. Additionally however the frame member 2060 here forms part of the housing of the machine and, as will be hereinafter described, performs additional support functions for other machine components as, for example, with respect to both sinker assembly support and sinker assembly displacement for stitch length control purposes.

As depicted on the left hand side of FIG. 2A, the outer cam tracks 2062 and 2064 in the vicinity of the selection points may function merely as recesses within which the needle and closing element butts can be accomodated, if necessary.

As will later become more apparent, the locus of control of the vertical location of the needle and closing element in the vicinity of the selection points has been shifted from the cam butts on the dependent ends of the needle and closing elements to the locus of auxiliary cam butts located near the upper ends of the needle and closing elements. To this end the controlled vertical positioning of the needle and closing elements in the vicinity of the selection points in the presently preferred knitting machine construction is primarily controlled by the disposition of auxiliary butts located near the upper ends of the needle and closing elements within an auxiliary channel. In accord therewith the cam tracks 2062 and 2064 may be made oversized in vertical extant or, if desired, may even by omited completely in such selection point areas.

The knitting needle cylinder 2042 is rotatably mounted relative to the inner sleeve member 2050 and outer frame member 2060 by the inter-engagement of support shoulder 2066 at its lower end with the movable inner race 2068 of the main cylinder support bearing 2070 and by the complemental support action of the shoulder 2045 on the bearing clamping ring 2043. The main cylinder support bearing 2070, which is preferably an "X contact" type of ball bearing, has its fixed outer race 2072 secured to the frame member 2060 through shoulder 2073 and retaining ring 2074. In a similiar manner the upper end portion of the knitting needle support cylinder 2042 is connected to the inner cam track sleeve support bearing 2078 through interengagement of shoulder 2080 with the outer rotatable race 2076 thereof and retaining ring 2082. The inner cam track sleeve support bearing 2078, which again is preferably an "X contact" type ball bearing, is connected to the stationary inner cam track sleeve 2050 through interengagement of shoulder 2084 and retaining ring 2088 with the inner stationary race 2086 thereof.

As will now be apparent, the presently preferred machine construction includes a simplified and improved main drive system wherein the knitting needle support cylinder 2042 is fixed in elevation and the rotative displacement thereof relative to the stationary inner cam tracks 2052 and 2054 and to the stationary outer cam tracks 2062 and 2064 is in directly coupled axial synchronism with the rotor 2032 of the main drive motor 2020. Additionally the drive power transmitted through the auxiliary drive shaft 2016 is directly synchronized with rotative displacement of the knitting needle support cylinder 2042 with the interposition of only one mechanical gear set (2044, 2046) therebetween.

SINKER ASSEMBLY

The presently preferred embodiment includes an improved construction for a sinker assembly that not only provides selectively controlled three dimensional sinker element displacement in conjunction with needle element displacement, but also provides for control of stitch length by variation in sinker assembly elevation relative to a fixed elevation knitting needle support cylinder 2042 and automatic compensation for variation in stitch length through accurate position control of the stitch loop during upward needle element displacement to accommodate the knitting of a wide variety of non-stretch spun yarns over a wide range of stitch lengths.

Referring now to FIGS 2A–7, mounted on the top of the stationary outer frame member 2060 is a sinker assembly, generally designated 2090, a portion of which is adapted to rotate in synchronism with the knitting needle support cylinder 2042 but to be independently vertically displaceable relative thereto for stitch length control purposes. To the above end and as best shown in FIGS. 2A–5, the presently preferred construction includes an annular disc shaped sinker assembly support plate 2092 mounted on the upper end of the stationary outer frame member 2060. The sinker assembly support plate 2092 includes an annular generally disc shaped upper body portion 2094 having a first dependent cylindrical flange or skirt portion 2096 disposed within an annular recess 2098 in the upper surface of the outer frame member 2060. The first dependent skirt portion 2096 is disposed in splined relation 2097 with the recess 2098 so as to preclude any rotatable displacement thereof relative to the knitting needle support cylinder 2042 but yet permit vertical displacement of the support plate 2092 as a unit relative to the outer frame member 2060 and the knitting needle support cylinder 2042. Adjacent to the outer marginal edge of the sinker assembly support plate 2092 is a second dependent flange 3000 having a threaded interior surface 3002. Positioned in spaced facing relation with the threaded surface 3002 is an exterior threaded surface portion 3004 of the outer frame member 2060. Disposed intermediate the threaded surfaces 3002 and 3004 is an elevator ring 3006 having a sector gear 3008 extending from one portion of the base thereof. The threaded surfaces 3002 and 3004 have differing thread pitches so that limited rotative displacement of the sector gear 3008 by a separate drive gear (not shown) and a concommitant limited rotation of the elevator ring 3006 relative to the frame member 2060 will effect an amplified vertical displacement of the sinker assembly support plate 2092. The vertical displacement of the sinker assembly support plate 2092 will, as hereinafter described, effect a corresponding vertical displacement of the entire sinker assembly mounted thereon.

Figure 4:
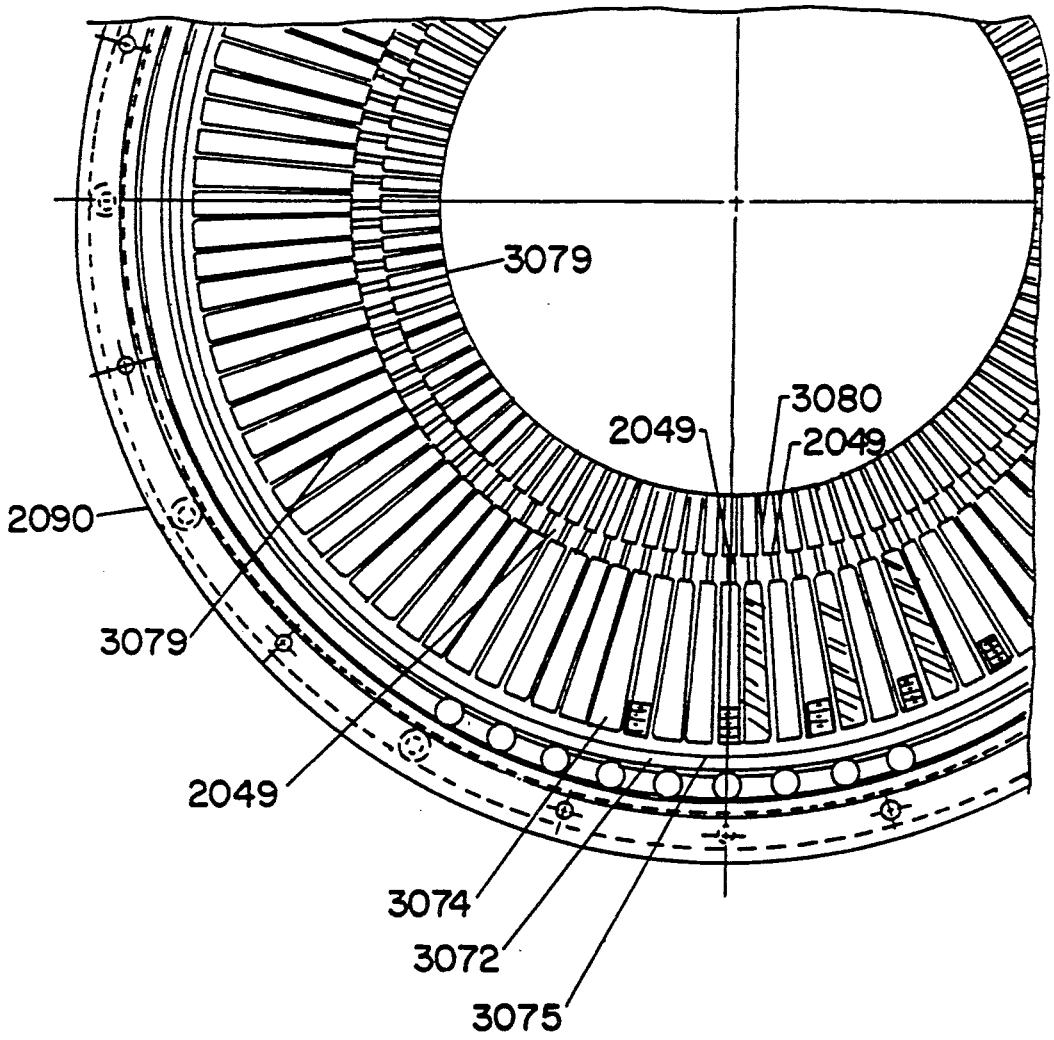
FIG. 4 is a sector shaped horizontal section as taken on the line 4—4 on FIG. 2A.
Figure 6:
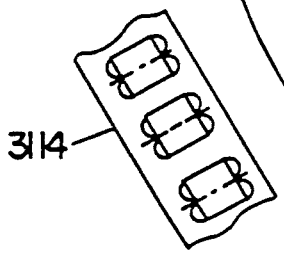
FIG. 6 is a development taken along the line 6—6 in FIG. 5.

Referring now to FIGS. 2A and 4, the support plate 2092 includes a marginal edge 3010 on upper body portion 2094 thereof. Supported thereon is a ring shaped frame element 3012 which in turn supports, in association with a spacer ring 3014, the outer fixed race 3016 of the sinker assembly support bearing 3018. Bolted to the frame element 3012 and spacer ring 3014 is an upper vertical elevation sinker cam ring 3020 having a vertical control cam surface 3022 overlying the upper edge portion 3024 of the body of a selectively shaped sinker element 3026. As will be apparent, the upper sinker cam ring 3020 is non rotatable and its elevation will be determined by the elevation of the sinker assembly support plate 2092.

Figure 7:
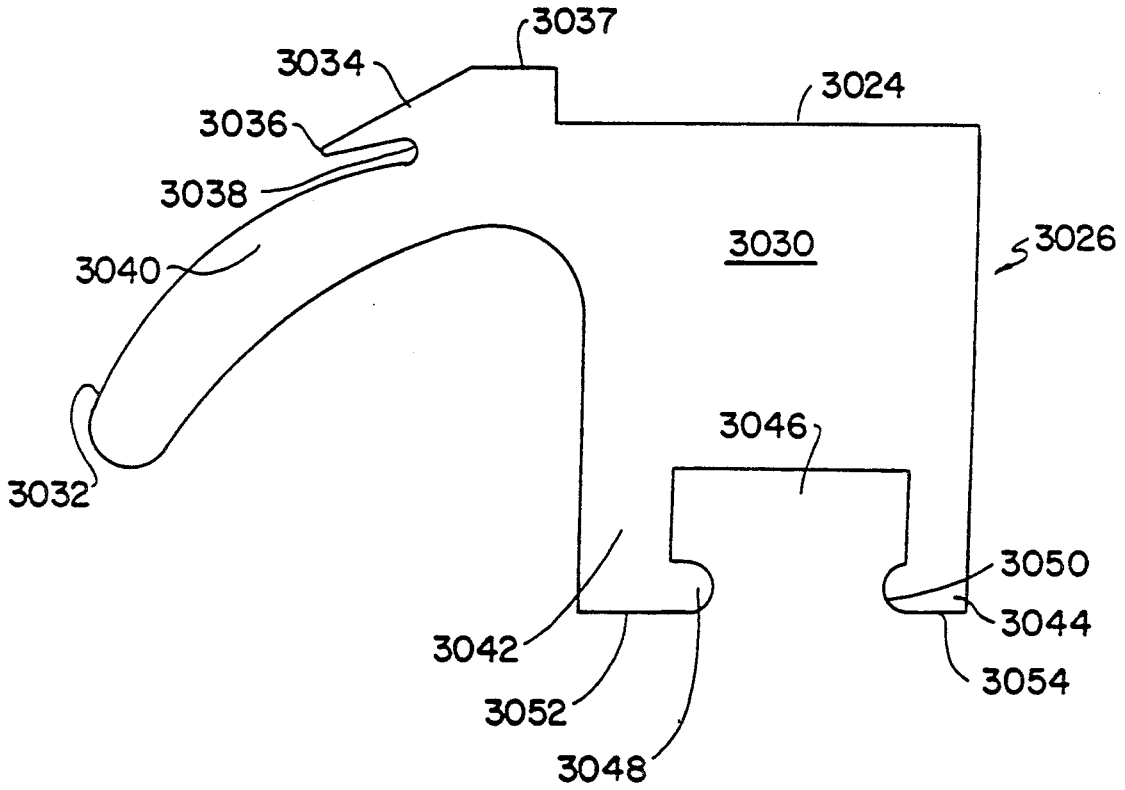
FIG. 7 is a side elevation of an improved sinker element configuration.

Referring now to FIGS. 2A and 7, the presently preferred configuration for the sinker element 3026 includes a rectangular body portion 3030 having an elongate arcuate nose portion 3032 extending from one side thereof. Overlying the upper end of the nose portion 3032 is a generally triangularly shaped segment 3034 providing an upwardly facing inclined surface or land 3036 which leads to a horizontal land 3037. Disposed beneath the inclined surface 3036 is a relatively deep hook like segment 3038 and an adjacent land 3040. The upper marginal edge 3024 of the rectangular body portion 3030 constitutes a cam follower surface adapted to be disposed in sliding contact with the overlying cam control surface 3022 on the upper sinker cam ring 3020. Dependent from the underside of the body portion 3030 are a pair of spaced downwardly extending legs 3042, 3044 defining a generally rectangularly shaped recess 3046 therebetween. The dependent ends of the legs 3042 and 3044 include inwardly facing cam follower lobes 3048 and 3050 respectively and adjacent flat cam follower surfaces 3052 and 3054, respectively.

As best shown in FIGS. 2A and 4 mounted on the rotatable inner race 3070 of the sinker assembly support bearing 3018 is a sinker pot web support ring 3072 having the spaced outer webs 3074 of the sinker pot base 3076 secured thereto by screws 3075. The sinker pot base 3076 is suitably apertured, as at 3078, to permit passage of the compound needle elements therethrough. The inwardly disposed portion of the sinker pot base 3076A supports the spaced inner webs 3080 and is also splined to the knitting needle support cylinder 2042, as at 3081, to assure conjoint rotation of the sinker pot and the sinker elements in conjunction therewith.

Referring now to FIGS. 2A and 4 the sinker elements 3026 are disposed within the slots 3079 intermediate the webs 3074 and 3080 and are supported by the engagement of the flat cam follower surfaces 3052 and 3054 on a pair of lower vertical control cam surfaces 3082 and 3084 disposed on either side of a recess 3086 on the upper surface of the body portion of the sinker assembly support plate 2092. Controlled vertical displacement of the sinker elements 3026 relative to the sinker pot 3076 is effected through the complemental compound contouring of vertical control cam surfaces 3082, 3084 and 3022 with the sinker elements 3026 always being confined top and bottom by cam control surfaces.

Disposed within the recess 3086 in the sinker assembly support plate 3092 is a radial sinker positioning cam ring 3090. As shown on the left hand side of FIG. 38A the radial sinker positioning cam ring 3090 is secured, as by bolts 3092, to an outwardly and upwardly extending boss 3094 on the upper locking channel ring 3096, and extends upwardly above the lower vertical cam control surfaces 3082 and 3084 on the upper surface of the sinker assembly support plate 2092. Such mounting fixes the elevation of the radial sinker positioning cam ring 3090 relative to the machine frame 2060 and renders the same independent of changes in elevation of the sinker assembly. The side walls of the radial sinker positioning cam ring 3090 serve as control cam surfaces engageable with the extending cam lobes 3048 and 3050 on the depending leg portions of the sinker elements 3026 to displace the sinkers radially and transverse to the direction of knitting needle advance. While the side walls of the sinker positioning cam ring 3090 are normally vertically disposed, as shown on the left hand side of FIG. 2A, they are selectively skewed at predetermined distances on either side of each yarn feed location, as shown on the right hand side of FIG. 2A, to provide for additional incremental transverse radial displacement at such locations. Such additional incremental transverse displacement compensates for variation in stitch length for non-spun yarns over the entire range of stitch length provided by elevation of the sinker assembly support plate 2092.

COMPOUND KNITTING NEEDLE MEMBERS

Figure 8:
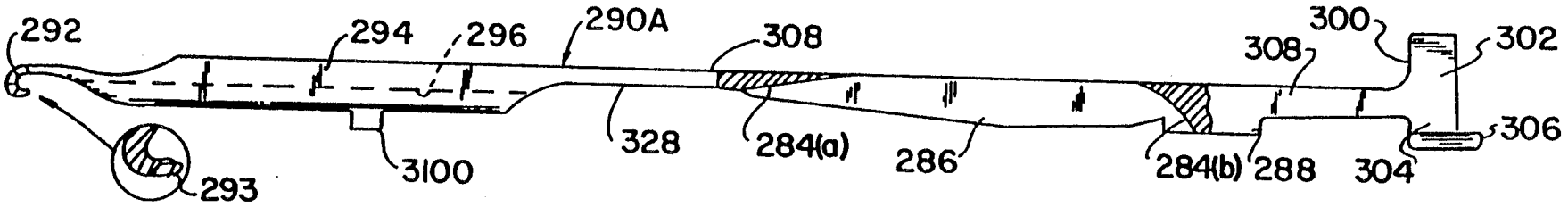
FIG. 8 is a side elevation, partially in section, of a presently preferred configuration for a flexible shank needle element.
Figure 9:
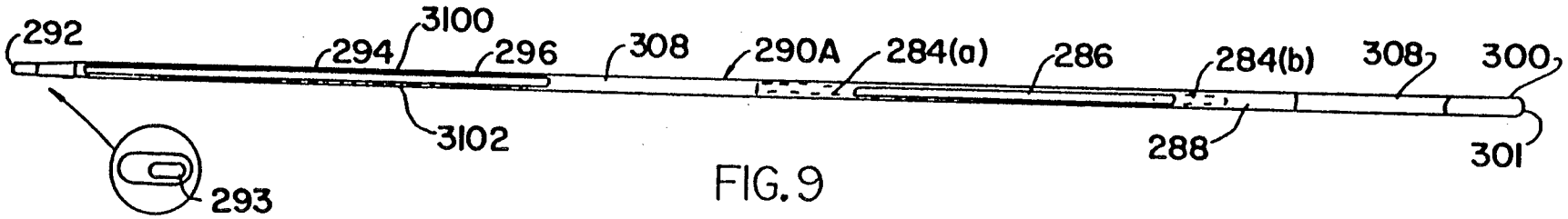
FIG. 9 is a plan view of the needle element illustrated in FIG. 8.
Figure 10:
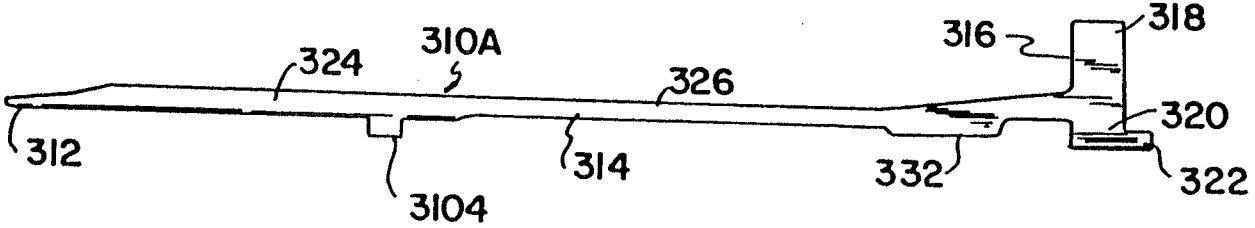
FIG. 10 is a side elevation of a presently preferred configuration for a flexible shank closing element for the needle element illustrated in FIG. 8 and 9.
Figure 11:
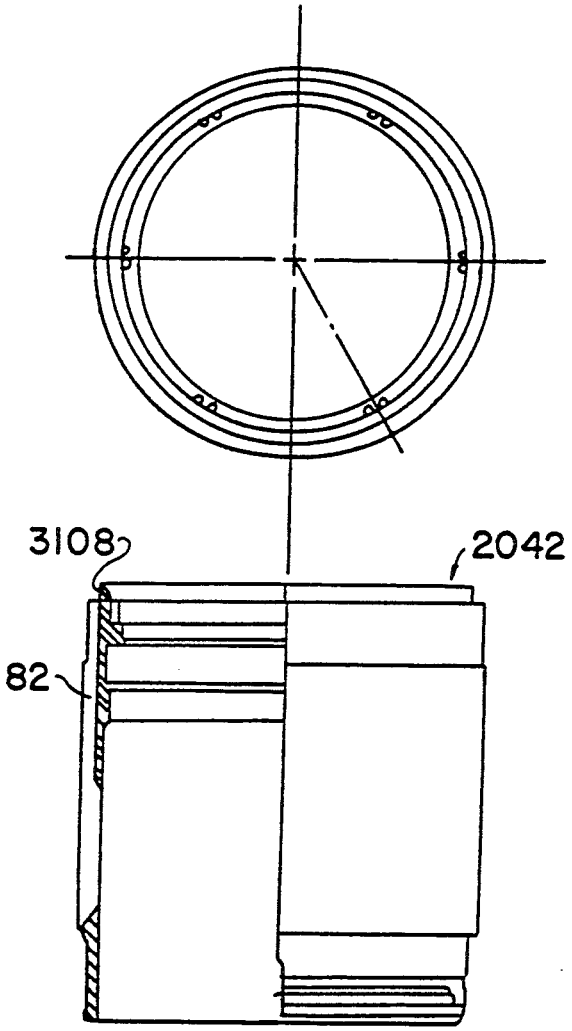
FIG. 11 is a partial vertical section through the knitting cylinder.
Figure 12:
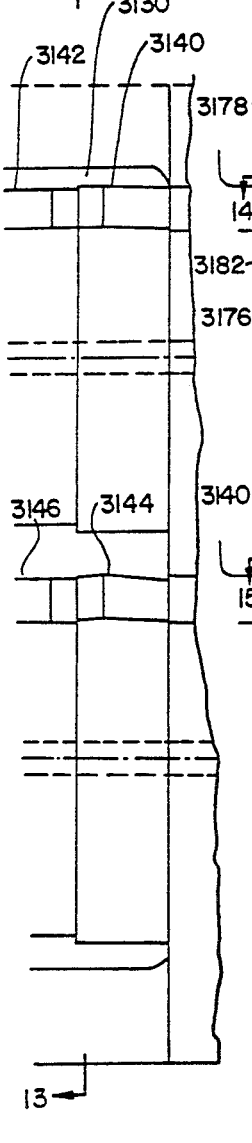
FIG. 12 is partial side elevational view, with the knitting cylinder removed, of a presser cam assembly.

The structure and configuration of the needle and closing elements constituting the compound knitting needle members employed in the presently preferred machine construction described in FIG. 1 and the following Figures are identical with those earlier described and depicted in FIGS. 9 and 12 of U.S. Pat. No. 4,608,839 except for one added particular and will not be herein entirely redescribed in detail. As best shown in FIGS. 8 and 9, which bear the same reference numerals as heretofore employed for the basic needle element structure, the elongate needle element 290A has added thereto an additional pair of similarly sized rectangularly shaped cam butts 3100, 3102 extending from the marginal edges of the walls of the upper bifurcated portion 294 and thereby are disposed on either side of the elongate channel 296. In a similar manner, and as best shown in FIG. 10, the elongate closing element 310A has added thereto an additional similarly sized and rectangularly shaped cam butt 3104 extending from the upper intermediate portion 324 thereof. The butt 3104 is located on the closing element in such manner as to be disposed between and in coaligned relation with the butts 3100 and 3102 when the closing elements is disposed in closed engagement with the hook portion of the needle member position in the vicinity of the selection points.

COMPOUND NEEDLE ELEMENT SELECTION AND DISPLACEMENT SYSTEM

The compound needle displacement and selection system employed in the presently preferred machine construction is essentially the same as these heretofore described in the parent application and will not be herein re-described in detail. One modification has been introduced in the provision of an auxiliary means to preclude longitudinal displacement of both the needle and closing elements of each compound needle for a predetermined distance on either side of each selection point and to thereby positively lock the vertical positioning of the needle and closing elements during the selection process. A second modification introduced by the presently preferred construction lies in the provision of improved means for positively displacing the upper portion of the needle and closing elements relative to fulcrum point within their respective knitting needle support cylinder slots 82 to bias the lower portion of both the needle and closing elements inwardly throughout the selection zone. A third modification lies in the provision of an improved presser cam assembly to positively displace the lower portions of the flexible shank needle and closing elements toward the selection heads at the selection points.

Figure 5:
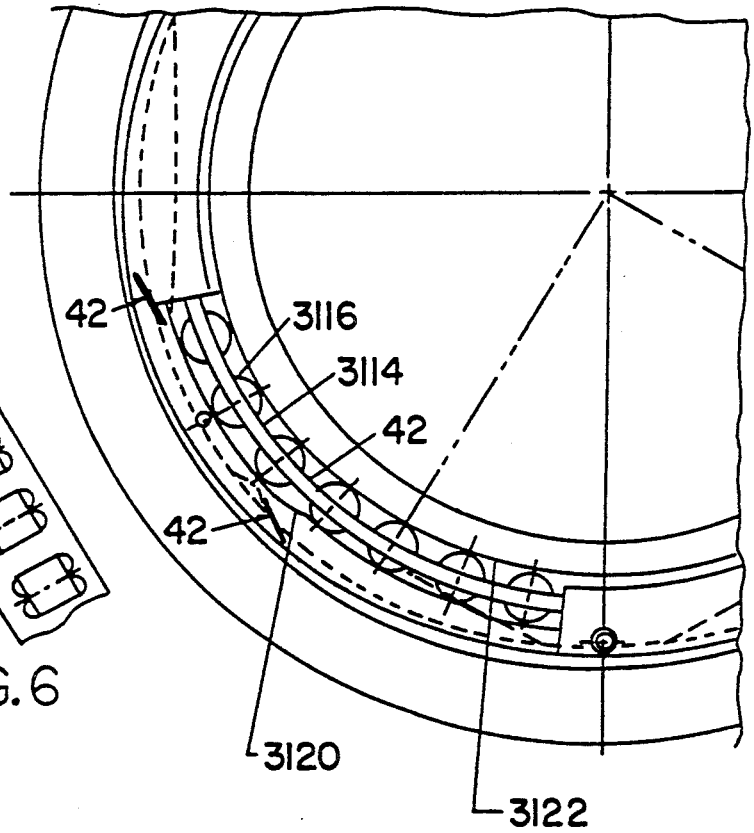
FIG. 5 is a sector shaped horizontal section as taken on the line 5—5 on FIG. 2A.

With respect to the first and second modifications and referring initially to FIGS. 2A and 5, there is provided a non-rotatable upper locking channel defining ring 3096 encircling the upper end of the knitting needle support cylinder 2042 and secured to the upper surface of the outer frame member 2060 by bolts 3110. Disposed immediately beneath the channel defining ring 3096 and clamped thereby is a roller ring assembly 3112. The roller ring assembly 3112 is constituted by the upper portion of a cage ring 3114, a plurality of individually radially displaceable rollers 3116 and the lower portion of the cage ring 3114 supported by the ring gear 2044. The rollers 3116 ride against a needle element compression cam track 3120 formed by the selective contouring of a portion of the adjacent wall of the outer frame 2060. The needle element compression cam track 3120 operates to radially displace the rollers 3116 in the inward direction against a flexible needle member compression band 3122 that encircles the knitting needle support cylinder 2042 in such manner as to deflect such band into compressive engagement with the adjacent exposed surfaces of both the needle elements and closing elements, as shown on the left hand side of FIG. 2, for a predetermined distance on either side of the selection points. The engagement of the compression band 3122 against the needle and closing elements in association with a slightly deepened needle guide slot 82 (see FIG. 11) effects localized needle and closing element deflection relative fulcrum location 3108 and in a concommitant greater inwardly directed deflection of the lower ends of the needle and closing elements.

The diametric extent of the inwardly facing displacement of the needle compression band 3122 by the rollers 3116. Such engagement and localized displacement effectively moves both the engaged needle and closing elements within deepened slots 82 the knitting needle support cylinder 2042 and cooperates with an overlying fulcrum location 3108 against which the upper portion of the needles and closing elements can pivot to create the desired flexure and inwardly directed displacement of the lower portions thereof during the selection process, as heretofore described in the earlier portions of this specification.

Figure 3:
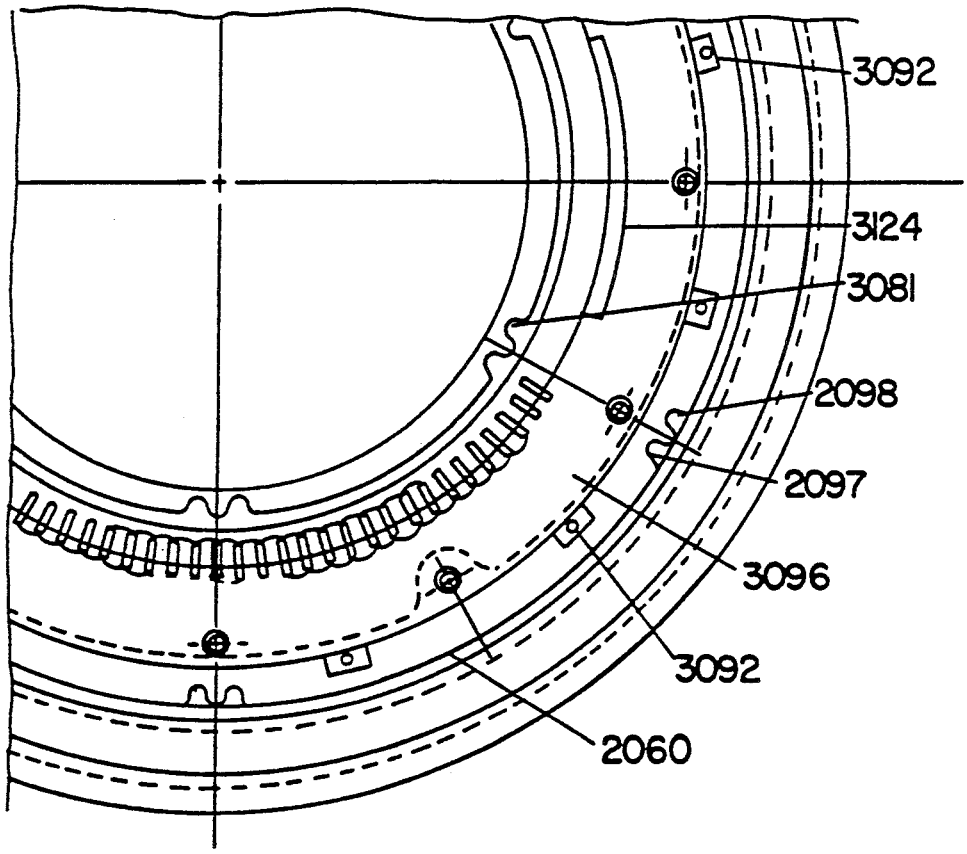
FIG. 3 is a sector shaped horizontal section as taken on the line 3—3 on FIG. 2A.

In contradistinction to the above described inward extensions of the upper channel defining ring 3096 to form the discrete butt receiving channel segments 3126 at the selection zones, the ring 3096 is further selectively contoured so as discontinue such inwardly extending and overlying marginal edge portions 3124 at all locations other than the selection zones, so as to permit, as illustrated on the right hand side of FIG. 2A and FIG. 3, unimpeded vertical displacement of both the needle and closing elements therepast at such other locations to effect the selected knit, tuck or float operations. Concurrently therewith, the needle element compression cam track 3120 effects an outwardly directed withdrawal of the rollers 3116 at such locations and a consequent release of radial inwardly directed displacement inducing pressure on the needle compression band 3122.

As generally noted above, the third modification included in the presently preferred construction for the circular weft knitting machine is a modified presser cam assembly at each of the selection zones. By way of general introduction, the presently preferred construction, as hereinafter described in greater detail, locates the preselection presser cam induced deflections of the cam butt bearing lower end portions of both the needle and closing elements in close proximity to the selection point to eliminate any possible needle member dead bands on either side of the selection point that might otherwise be attendant changes in direction of knitting cylinder rotation rotation.

As best shown on the left hand side in FIG. 2 and in FIGS. 12–15, the inner cam track sleeve 2050 is vertically slotted at the selection zones, as at 3130, to accommodate the inclusion therein of two pairs of vertically disposed presser cams, the upper pair of which is generally designated 3132 and the lower pair of which is generally designated 3136. Disposed within the nonrotating inner cam track sleeve 2050 and serving as one of the defining walls of each of said slots 3130 is a nonrotatable but vertically displaceable presser cam sleeve member 3134.

Figure 14:
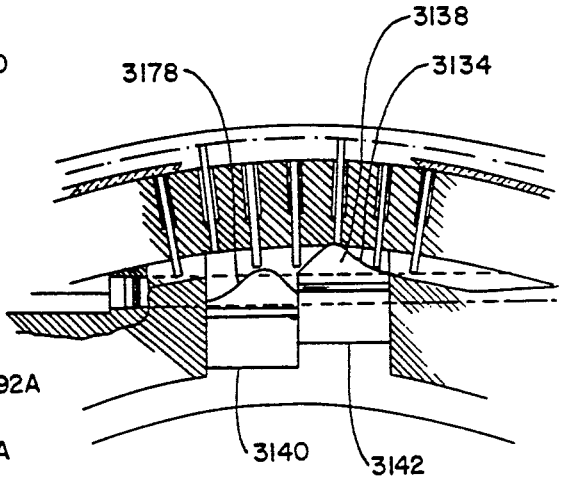
FIG. 14 is a partial horizontal section taken on the line 14—14 of FIG. 13.
Figure 15:
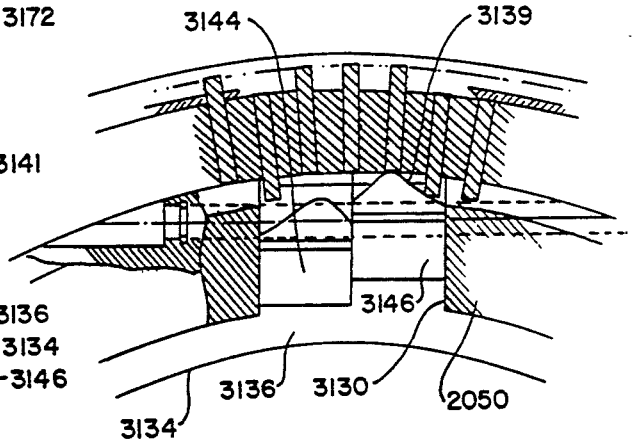
FIG. 15 is a partial horizontal section taken on the line 15—15 of FIG. 13.

The upper presser cam assembly pair 3132 includes upper side by side presser cams 3140 and 3142 for effecting positive deflection, as at 3138 in FIG. 14, of the lower ends of the closing elements. The lower presser cam assembly pair 3136 includes lower side by side presser cams 3144 and 3146 for effecting positive deflection, as at 3139 of FIG. 15, of the lower ends of the needle elements.

Referring now to FIGS. 2A and FIGS. 13–15 and utilizing the upper pair of upper side by side presser cams 3140 and 3142 as exemplary, and with the further understanding that presser cams 3140 and 3142 are mirror images of each other, each presser cam includes a pair of terminally located cam follower lobes 3170 and 3172 extending inwardly of the inner surface thereof. Each presser cam in the pair thereof is mounted on and adapted to be individually and independently rotatably displaced about a common pivot axis 3174. The upwardly extending end portion 3176 of each presser cam in the upper pair 3132 thereof is longitudinally slotted, as at 3178, to form a pair of bifurcated elongate resilient arms 3180 and 3182 with the arm 3180 having the cam follower lobe 3170 on the terminal end of the inner facing surface thereof. The bifurcated character of the upper portion thereof renders the arms 3180 and 3182 somewhat resilient and such resilience functions to accommodate varying tolerances and wear of the machine components and affords an extended operating life to the presser cams.

Mounted at the end of the outwardly facing surfaces of the arm 3182 of each cam 3140 and 3042 in the upper pair 3132 thereof is a selectively contoured cam surface 3178 adapted to engage and deflect the extending butts at the bottom ends of the closing elements. As is apparent from FIG. 14, presser cam 3142 is of similar configuration to that of presser cam 3140 except that the contoured cam surface 3184 thereon is a mirror image of cam surface 3178 to accommodate bidirectional knitting cylinder displacement.

As is apparent from the drawings, the lower pair 3136 of side by side presser cams 3144 and 3146 are of identical construction as that described above for the upper pair 3132 of presser cams 3140 and 3142.

Figure 13:
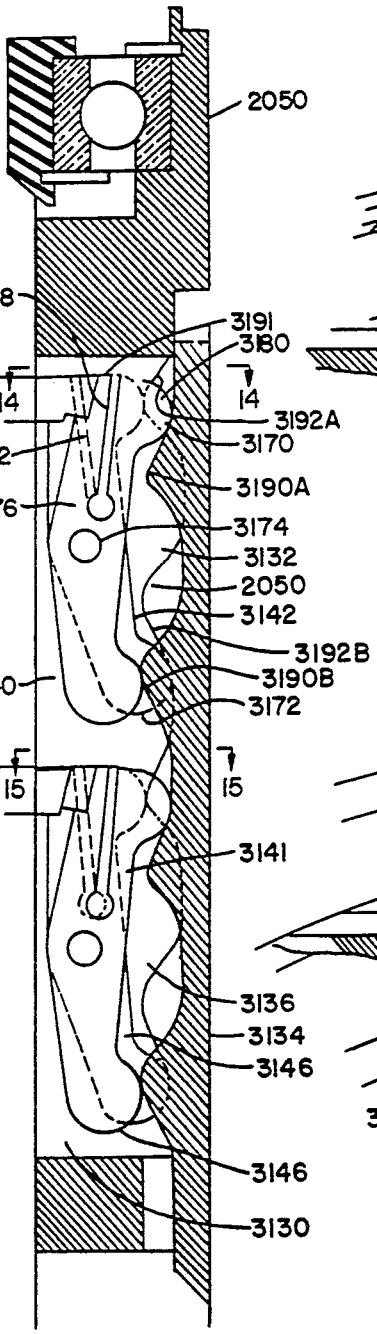
FIG. 13 is a partial vertical section as taken on the line 13—13 of FIG. 48.

Referring now to FIGS. 2A, 2B and 13, the presser cam sleeve member 3134 includes a first conjugate pair of presser cam member shifting cams 3190A and 3190B and 3192A and 3192B and a second identical pair of conjugate presser cam shifting cams for the lower pair of presser cams 3136. Such shifting cams effect pivotal displacement of the associated presser cam when the presser cam sleeve member 3134 is vertically reciprocated intermediate an upper and a lower position. Such vertical reciprocation is effected by solenoids 3198 and 3200 located at the lower end of the sleeve member 3134 as shown in FIG. 2B.

As will be apparent, when the presser cam sleeve member 3134 is moved to its upper position, the shifting cam 3190A will engage cam lobe 3170 to relate presser cam 3140 and cause contoured presser cam face 3178 to move into engagement with the closing element butts to effect positive displacement thereof. Simultaneously however the adjacent presser cam 3142 mounted on common pivot 3174 will be retracted disengaging contoured cam face 3184 from engagement with the closing element butts.

When the presser cam sleeve 3134 is in its lower position as shown in FIG. 13, the contoured cam face 3184 of presser cam 3142 is in its advanced position to engage th closing element butts due to engagement of shifting cam lobe 3192A with accompanying displacement of the cam follower lobe 3191. As will now be equally apparent, a similar mode of operation is simultaneously effected for the lower pair of presser cams 3136 which engage the needle element butts.

Having thus described my invention, I claim:

1. In a circular weft knitting machine of the type having a rotatably displaceable knitting cylinder with a plurality of longitudinally displaceable elongate flexible shank knitting needle members slidably contained within individual guide channels on the outer surface thereof, and means defining a fulcrum location near the upper ends of said needle element for permitting flexure induced displacement of the shank portion thereof.

the improvement comprising a conjointly rotatable flexible band disposed below said fulcrum location in closely encircling relation with the upper portion of said rotably displaceable knitting cylinder and in interfacial engagement with said elongate knitting needle members slidably contained in said guide channels therein, and means for selectively deflecting the portions of said conjointly rotatable flexible band at selected locations on the locus of rotation thereof to inwardly displace the portions of the needle members engaged thereby relative to said fulcrum to effect a dimensionally enhanced inward displacement of the lower shank portions thereof.

2. The improvement as set forth in claim 1 wherein said last mentioned means comprises a plurality of individually radially displaceable roller elements disposed in rolling engagement with the outer surface of said flexible band and means for selectively displacing said rollers radially of said knitting cylinder to inwardly displace portions of said flexible band at said selected locations.

3. The improvement as set forth in claim 2 wherein said means for displacing said rollers radially of said knitting cylinder comprises a fixed cam track disposed in spaced encircling relation with said flexible band.

* * * * *